US007511445B2

(12) United States Patent
Camarena Villaseñor

(10) Patent No.: US 7,511,445 B2
(45) Date of Patent: Mar. 31, 2009

(54) METHOD OF MANUFACTURE OF MAGNETIC INDUCTION DEVICES

(76) Inventor: Jose De Jesus Camarena Villaseñor, La luna 2584, Col. Jardincs del Bosque, Guadalajara, Jalisco (MX) CP 44520

( * ) Notice: Subject to any disclaimer, the term of this patent is extended or adjusted under 35 U.S.C. 154(b) by 733 days.

(21) Appl. No.: 11/179,066

(22) Filed: Jul. 12, 2005

(65) Prior Publication Data

US 2006/0283006 A1 Dec. 21, 2006

(51) Int. Cl.
*H01F 7/06* (2006.01)

(52) U.S. Cl. ..... 318/729; 336/83

(58) Field of Classification Search ..... 219/645, 219/635, 646; 29/602.1; 333/24 R, 167; 318/20, 813, 767, 729; 336/110, 115, 83
See application file for complete search history.

(56) References Cited

U.S. PATENT DOCUMENTS 4,723,104 A 2/1988 Rohatyn ..... 318/813
5,416,687 A * 5/1995 Beasley ..... 363/44
5,771,168 A * 6/1998 Liao et al. ..... 363/143
6,891,447 B2 5/2005 Song ..... 333/24 R
6,906,608 B2 6/2005 Fujiwara ..... 336/110
6,984,964 B2 * 1/2006 Chang ..... 323/207
7,265,650 B2 * 9/2007 Jang et al. ..... 336/212
7,292,013 B1 * 11/2007 Chen et al. ..... 323/222

* cited by examiner

*Primary Examiner*—Daniel L Robinson
(74) *Attorney, Agent, or Firm*—Buskop Law Group, PC; Wendy Buskop

(57) ABSTRACT

Method for manufacturing magnetic induction devices to control electricity entail mixing a resin with a polymer forming a mixture; adding a transition metal to the mixture forming a metalized mixture; adding dimethyl sulfoxide to the metalized mixture; mixture forming a liquid metalized mixture; adding a magnetic powder to the liquid metalized mixture forming a magnetized mixture; and adding a catalyst to the magnetized mixture forming a hot mixture due to an exothermic reaction. The hot liquid is poured into two or more molds. A gap or channel is formed in each section. The sections are allowed to cool, removed from the molds, and fastened together such that the channel runs the length of the device. A one-piece magnetic induction device can also be formed using these methods. The formed magnetic induction device applies a magnetic field region to a power delivery line to reduce amperage up to about 25%.

20 Claims, 7 Drawing Sheets

METHOD OF MANUFACTURE OF MAGNETIC INDUCTION DEVICES

CROSS REFERENCE TO RELATED APPLICATIONS

The present application claims priority to co-pending Mexican National Patent Application Serial Number JL/E/2005/000279, filed on Jun. 21, 2005.

FIELD

The present embodiments relate generally to methods of manufacture of a magnetic induction device used as an energy saving device.

BACKGROUND

In the design, construction, and presentation of many electrical and electronic circuits of all sorts, the use of inductive elements is relied upon for a variety of electrical circuit reactance purposes. Generally, in many alternating current circuits over a wide range of frequencies, but usually below one MHz, the use of inductors is required to counteract apparent negative resistance as such might appear in electrical terms to a source of alternating current electrical energy. For example, power factor correction circuitry for use in association with various kinds of motor control or lighting control circuits will require the use of inductive elements. Other typical circuits can include power electronics such as power supplies for a variety of electrically operating devices, or any such circuit which requires the use of a filter tank circuit to reduce variation of power factor values, and to diminish any electric noise generated or transmitted back to a power source.

Currently available inductors have a number of characteristics which have been, heretofore, difficult to avoid because the use of inductors has been required. For example, current inductors are bulky, hard to mount, expensive, and have poor tolerance—that is, the specific inductance reactance of any particular inductor might range as much as 10% to 20% of its rated value. For inductors that have tolerances in the range of 1% of rated value, the prices are significantly higher than inductors with poorer tolerance.

In general, prior art inductors require a core around which a number of windings or coils of wire such as copper wire are placed. Even with automated equipment, the production of inductors is expensive; and if inductors that have very little tolerance with respect to their rated value are required, the inductors might be required to have been manually constructed or at least manually adjusted.

Generally, a core has been required to be present in inductors, especially those relying on the permeability of the core as compared with the permeability of air to make the inductor much smaller. The cores must first be manufactured, and then the inductor wound on the cores; and thus, the inductor is both bulky and expensive. Usual cores have been ferromagnetic or permalloy, and they are thus relatively heavy due to the density of the core material. Still further, depending on the core material being used, there may be excessive eddy currents that are developed, and the hysteresis or gauss curves may be very non-linear. Even further, different materials for the core may be required depending on the intended operating frequency at which the inductor will be used. This may increase the necessity for higher inventory amounts of inductors, even though they may have the same inductive ratings; and, once again, the requirement for differing core materials adds to the cost of production and acquisition of inductors.

For a variety of reasons, inductors that are presently available may be presented in a variety of configurations. For example, the cores may be torrodial. The cores may have E-shaped core or H-shaped core configurations, or the cores may be wound on a post or bobbin, so that in all events the inductors are quite bulky. Without the addition of a mounting frame, or unless the inductors are cast or potted into a lacquer or other potting material, presently available inductors are difficult to mount, and they may be somewhat fragile in that they may be incapable of withstanding severe shocks.

If an inductor having a specific reactive value, within quite tight tolerance levels is required, that inductor must have a specific and controlled gap—which would be determined according to the manner in which the inductor is constructed—and creating a specific and controlled gap may be quite labor intensive and thus expensive.

A need exists for a method of manufacture to create a device to save electric energy. The device should be composed from a combination of specials resins and magnetism that gives the device the capacity to save more energy compared to other conventional devices.

The present embodiments meet these needs.

BRIEF DESCRIPTION OF THE DRAWINGS

The detailed description will be better understood in conjunction with the accompanying following drawings.

The present embodiments are detailed below with reference to the listed Figures.

DETAILED DESCRIPTION OF THE EMBODIMENTS

Before explaining the present embodiments in detail, it is to be understood that the embodiments are not limited to the particular embodiments and that it can be practiced or carried out in various ways.

The present embodiments are directed towards methods of manufacture for devices used to save energy usage by machines that use inductive energy, resistant energy and capacitive energy. The embodied methods create devices that act directly by increasing the electromagnetic fields of the motor. The effect of the magnetism is that the consumption in kilowatts is decreased. The resistant current increases the electron acceleration by means of the chemical-magnetic mixture, thereby decreasing the current load, and thereby saving kilowatts/hour.

An electrical energy saving device or magnetic induction device created by the embodied methods is adapted to surround a power delivery line, such as a single power delivery line providing electricity with voltage and amperage. The created magnetic induction device applies a magnetic field region to the power delivery line and reduces the amperage of the electricity of up to about 25%, wherein the magnetic induction device. The magnetic induction device forms a magnet field with a magnetic bias and a resistance that is applied to the power delivery line. The resistance can range from about 0.5 ohms to about 1 ohm.

The embodied magnetic induction devices formed by the methods of manufacture increase electromagnetic energy based on the resistance and the capacity of the electric line, thereby affecting the induction in a motor to reduce electrical usage by a motor. In practice, the embodied magnetic induction devices have reduced electrical needs in a cement plant by 20%. Only one embodied magnetic induction device is needed per power delivery line incoming into a facility to reduce the overall kilowatts. The embodied magnetic induction devices can reduces need for electricity on existing lines by 20%.

Figure 2A:
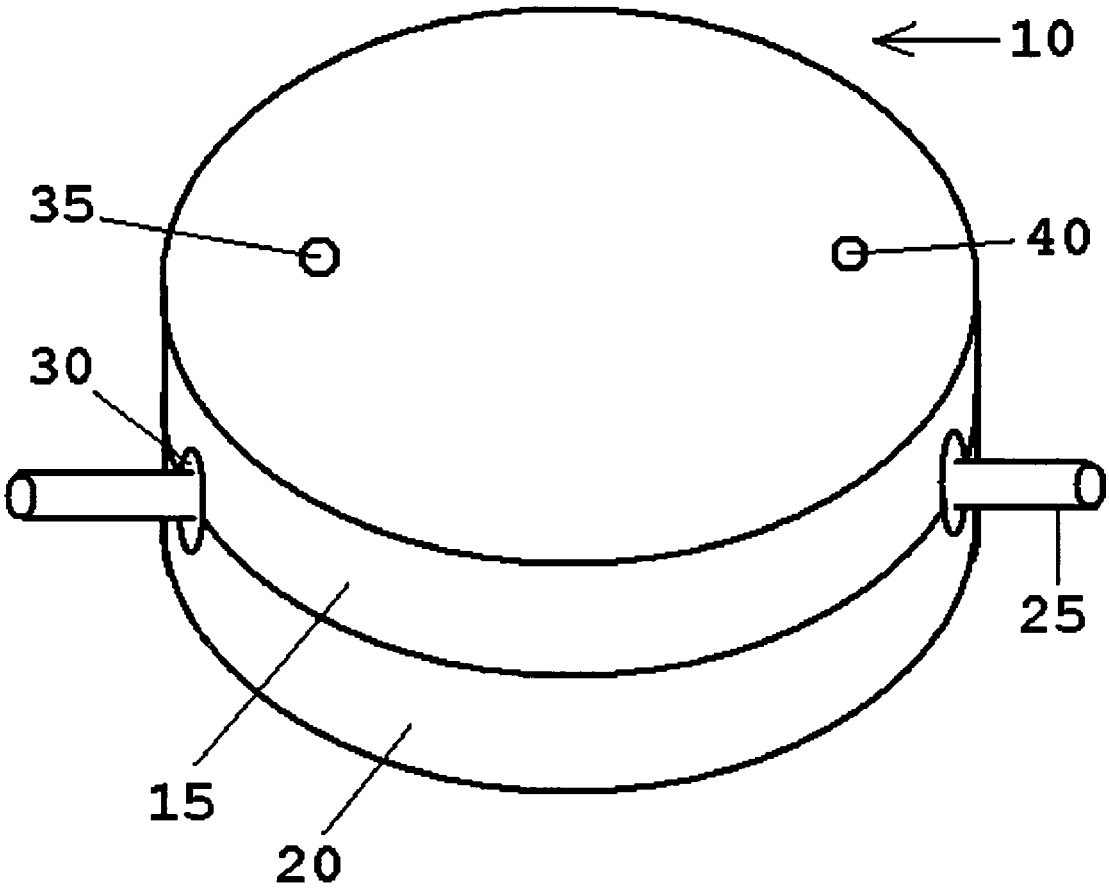
FIG. 2A depicts a perspective view of a two-piece embodiment of a magnetic induction device installed on a single power delivery line.
Figure 2B:
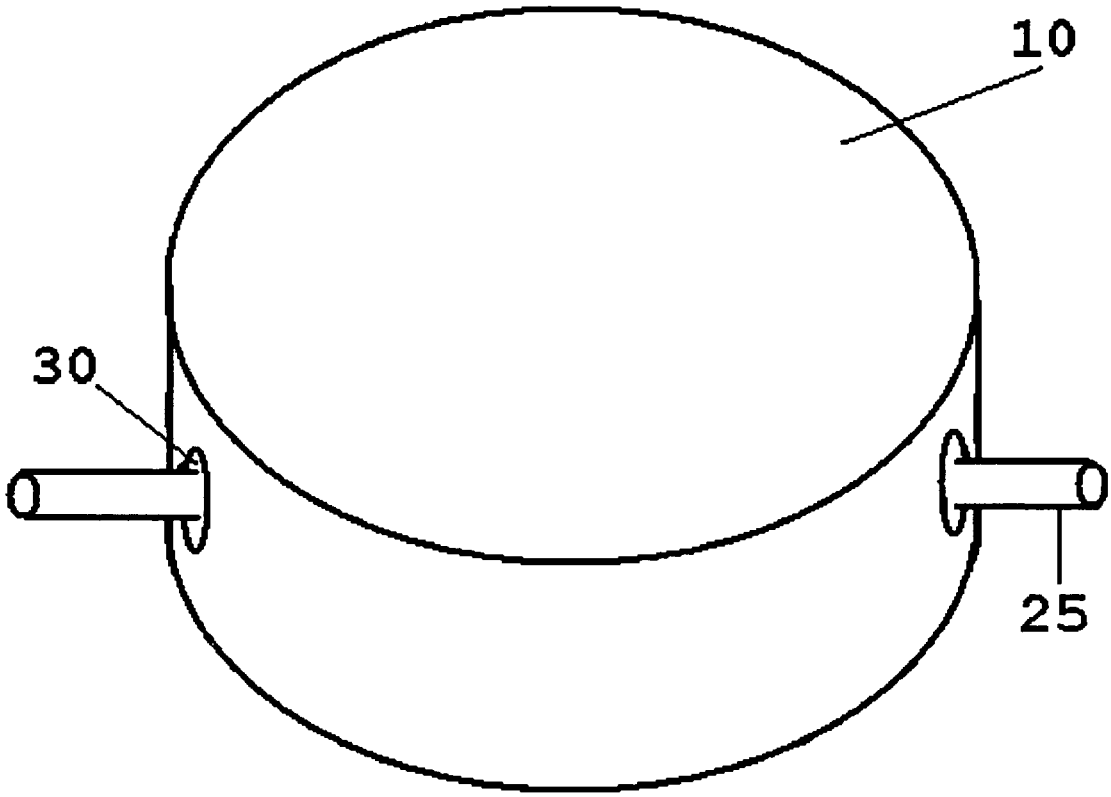
FIG. 2B depicts a perspective view of a one-piece embodiment of a magnetic induction device installed on a single power delivery line.

The methods of manufacture create magnetic induction devices that can be a one-piece or two-piece mold that includes a cavity or gap. The embodied magnetic induction device is designed so that the power delivery line runs through the device via the gap or cavity, as depicted in FIG. 2A and FIG. 2B.

The magnetic induction device created by the embodied methods of manufacture can be used on networks of general distribution of feeding electricity to motors and resistance directly to motors or electrical circuits. The magnetic induction device can be placed on the power delivery line incoming into a facility to reduce the overall kilowatts used by the facility. The embodied magnetic induction device applies the magnetic field region linearly along the power delivery line.

Figure 1A:
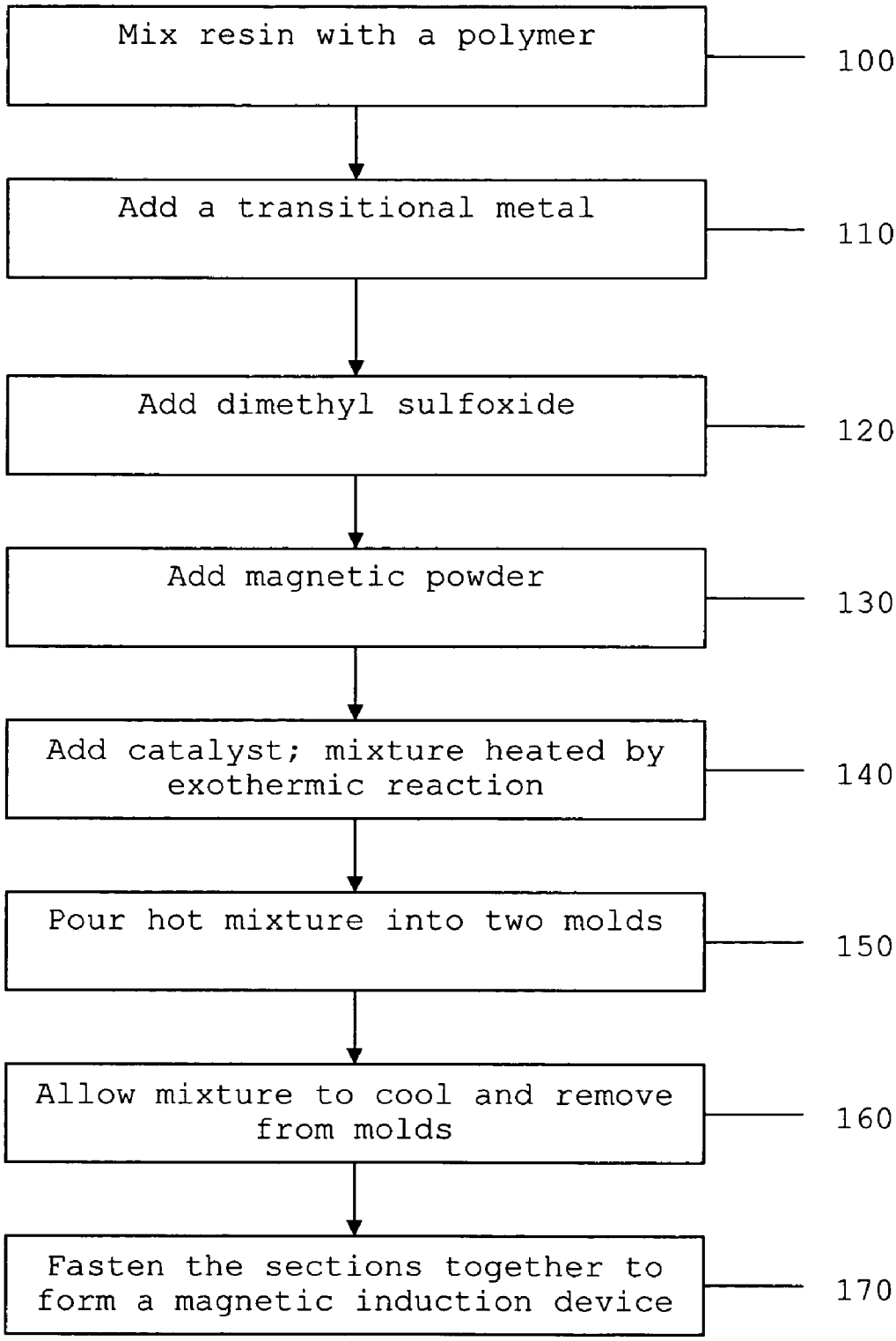
FIG. 1A depicts a schematic of an embodiment of a methods of manufacture of a two-piece embodiment of a magnetic induction device.

With reference to the figures, FIG. 1A depicts an embodiment of method for making a two-pieces magnetic induction device to save energy. The method begins by mixing a resin with a polymer forming a mixture (Step 100). A transition metal is added to the mixture forming a metalized mixture (Step 110). The transition metal can be added to the metalized mixture using a low shear mixer. Dimethyl sulfoxide is added to the metalized mixture as a liquid solution forming a liquid metalized mixture (Step 120). Dimethyl sulfoxide is added as a liquid solution. Magnetic powder is added to the liquid metalized mixture forming a magnetized mixture (Step 130). Next, a catalyst is added to the magnetized mixture forming a hot mixture (Step 140). Adding the catalyst causes an exothermic reaction, thereby heating the hot mixture to a temperature of up to about 250 degrees Fahrenheit.

The embodied methods continue by pouring the hot mixture into a first mold and a second mold forming a first section and a second section (Step 150). The sections are cooled to ambient temperature and removed from the molds (Step 160). A gap or channel is formed in each section. The gap or channel can be formed by drilling after the mold has cooled or by the shape of the mold itself. The molds can be allowed to cool for a time period of up to three hours in order to ensure the sections have sufficiently hardened.

The sections are fastened together so that the gaps or channel in each section are aligned forming a channel or gap that internally extends the diameter or length of the device (Step 170). The sections can be placed over a power delivery line so that gap or channel encloses the power delivery line without adding compression.

The embodied methods can include adding one or more of the following to the mixture: a pigment, a filler, a UV stabilizer, or other additives. Examples of additives include additives to reduce brittleness of the magnetic induction device and additives to improve flexural modulus of the magnetic induction device.

Figure 1B:
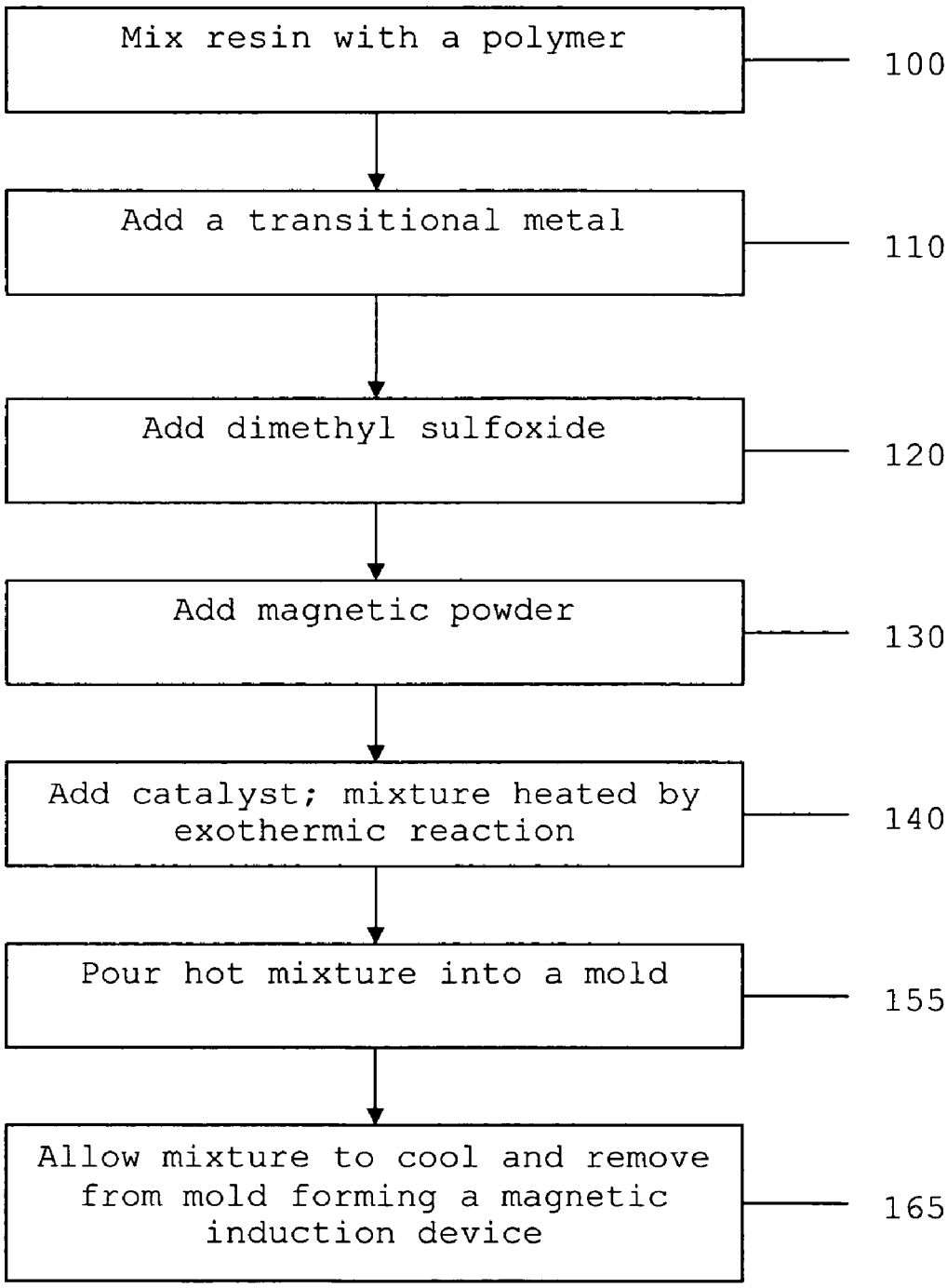
FIG. 1B depicts a schematic of an embodiment of a methods of manufacture of a two-piece embodiment of a magnetic induction device.

FIG. 1B depicts an embodiment of method for making a one-piece magnetic induction device. The method entails mixing a resin with a polymer forming a mixture (Step 100); adding a transition metal to the mixture forming a metalized mixture (Step 110); adding dimethyl sulfoxide to the metalized mixture forming a liquid metalized mixture (Step 120); adding a magnetic powder to the liquid metalized mixture forming a magnetized mixture (Step 130); and adding a catalyst to the magnetized mixture forming a hot mixture (Step 140).

The hot mixture is pored into a mold to form a magnetic induction device (Step 155). The mold is such that the magnetic induction device includes a gap or channel that internally extends the diameter or length of the device. The gap or channel fits around a power delivery line without adding compression. The magnetic induction device is allowed to cool to ambient temperature and is removed from the mold (Step 165).

As an example method, the magnetic induction device is made by mixing 40 wt % of an epoxy resin with a 31 wt % of a monomer for between one and two minutes to form a mixture. A black pigment (5 wt %) is added during the mixing. Next, cobalt (6 wt %) or a similar transition metal is mixed into the mixture for between one and two minutes in a low shear mixer, thereby creating a metalized mixture. To form a liquid metalized mixture, dimethyl sulfoxide (3 wt %) in the form of a liquid solution is mixed into the metalized mixture for between one and two minutes. The dimethyl sulfoxide is in liquid form, but not in a water carrier. Sm—Co magnet powder (10 wt %) or other similar magnetic powder is mixed into the liquid metalized mixture for between one and two minutes, thereby forming a magnetized mixture. A catalyst (5 wt %) is mixed into the magnetized mixture for between one and two minutes. When the catalyst is added to the magnetized mixture, an exothermic reaction occurs, thereby forming a hot mixture with a temperature of up to about 250 degrees Fahrenheit.

The hot mixture is poured into two separate molds forming a first section and a second section. The molds are constructed to form a channel in both of the sections. The first section and the second section are allowed to cool for about thirty minutes until the sections are at ambient temperature. The sections are removed from the molds and fastened together such that the channels in each section are aligned forming a channel that extends the length of the formed device.

The magnetic induction devices formed by the methods of manufacture are composed of from about 35 wt % to about 45 wt % of an epoxy resin, from about 30 wt % to about 40 wt % of a polymer monomer; from about 1 wt % to about 4 wt % of dimethyl sulfoxide, from about 4 wt % to about 7 wt % of a transition metal; from about 10 wt % to about 20 wt % of a magnetic; and from about 1 wt % to about 5 wt % of a catalyst.

Example polymers include polypropylene, polyethylene, polybutylene, polyamide, and combinations thereof. Example transition metals include cobalt, vanadium, molybednum, iridium, iron, zinc, titanium, and combinations thereof. Similar elemental and compound metals with similar qualities can be used. The given list includes example of the transition metals successfully used.

Examples of the magnetic material include beryllium, magnesium, calcium, radium, barium, strontium, and combinations thereof. Further examples of the magnetic material include Sm—Co magnet powder, Nd—Fe—B magnet powder, Sm—Fe—N magnet powder, and combinations thereof. Again, similar elemental and compound metals with similar qualities can be used. The given list includes example of the transition metals successfully used.

The magnetic induction devices can further include from about 4 wt % to about 6 wt % of a pigment. The pigment is used to color the final mold of the magnetic induction device. Examples of pigments colors include black, red, blue, grey, white, yellow, and combinations thereof. The color can be chosen to fit the end use. For example, the black color is used with low tension power delivery lines in order to blend into the power delivery system.

The magnetic induction devices can further include about 2 wt % to about 4 wt % of a UV stabilizer. The UV stabilizer can be added to absorb the energy of the polymer before photochemical degradation can take place. Other examples of uses for the UV stabilizer include singlet oxygen quenching, radical scavenging and hydroperoxide decomposition. Examples of UV stabilizers include benzophenones, benzotriazoles, substituted acrylates, aryl esters and compounds containing nickel or cobalt salts.

The magnetic induction devices can further include from about 1 wt % to about 7 wt % additive. Additives can be added to reduce brittleness of the magnetic induction device. For example, a tough polyamide resin can be added to the mixture before the mold is created. Further, an additive, such as an elastomer, can be included to improve flexural modulus of the magnetic induction device. Further, the embodied magnetic induction device can further include from about 3 wt % to about 15 wt % of a filler, such as talc.

As an example, a magnetic induction device can be a mold composed of 40 wt % epoxy resin; 33 wt % monomer; 3 wt % dimethyl sulfoxide; 4 wt % cobalt; 5 wt % black pigment; 10 wt % magnetic material; 5 wt % catalyst. The magnetic induction device can reduce the amperage up to about 25%.

Continuing with the figures, FIG. 2A depicts a perspective view of a two-piece embodiment of a magnetic induction device (10) installed on a single power delivery line (25). FIG. 2B depicts a perspective view of a one-piece embodiment of a magnetic induction device (10) installed on a single power delivery line (25). The embodied magnetic induction device can have an overall diameter ranging from about 1.5 inches to about 4 inches. The embodied magnetic induction device can be formed in various shapes, such as of elliptoid, circular, rectangular. The figures depict the circular embodiment.

Figure 3:
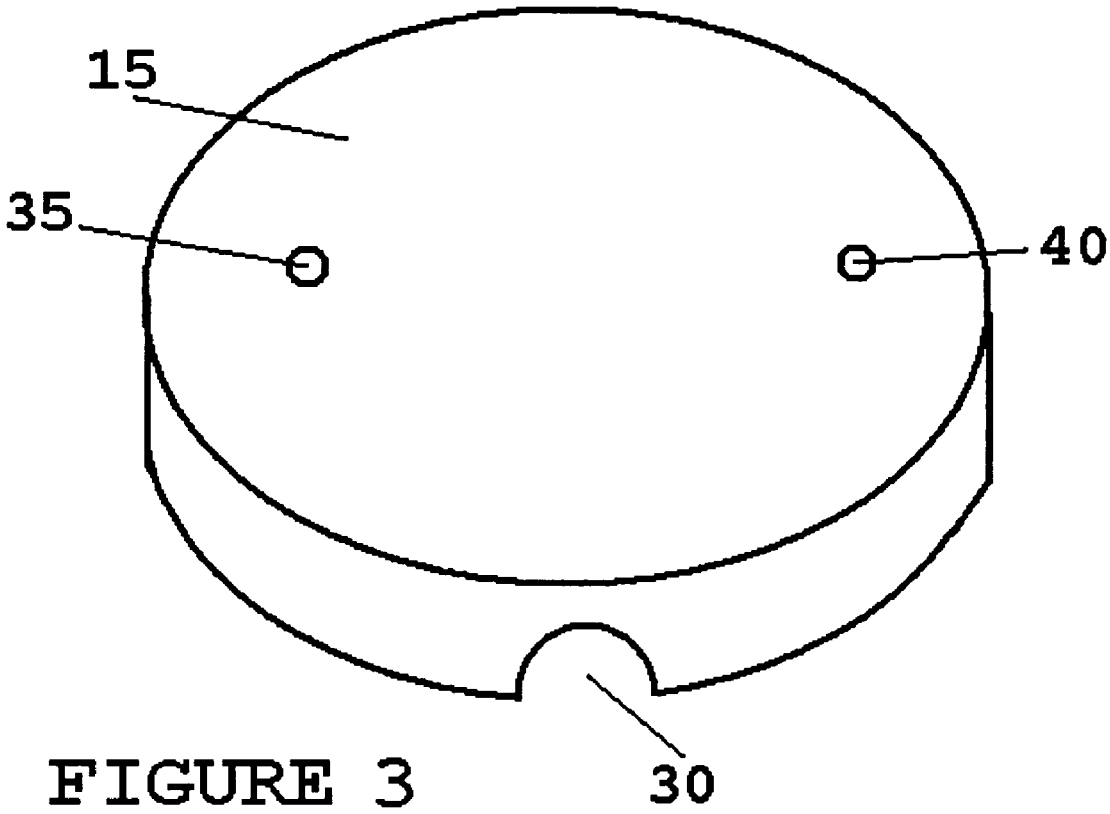
FIG. 3 depicts a perspective view of an embodiment of a piece of a two-piece embodiment of a magnetic induction device.

A two-piece embodiment of a magnetic induction device (10) is formed by joining a first section (15) and a second section (20). FIG. 3 depicts a perspective of view of a first section (15). The first section (15) has a channel or gap (30). The second section has a channel or gap that mirrors the channel or gap in the first section (15).

Figure 4:
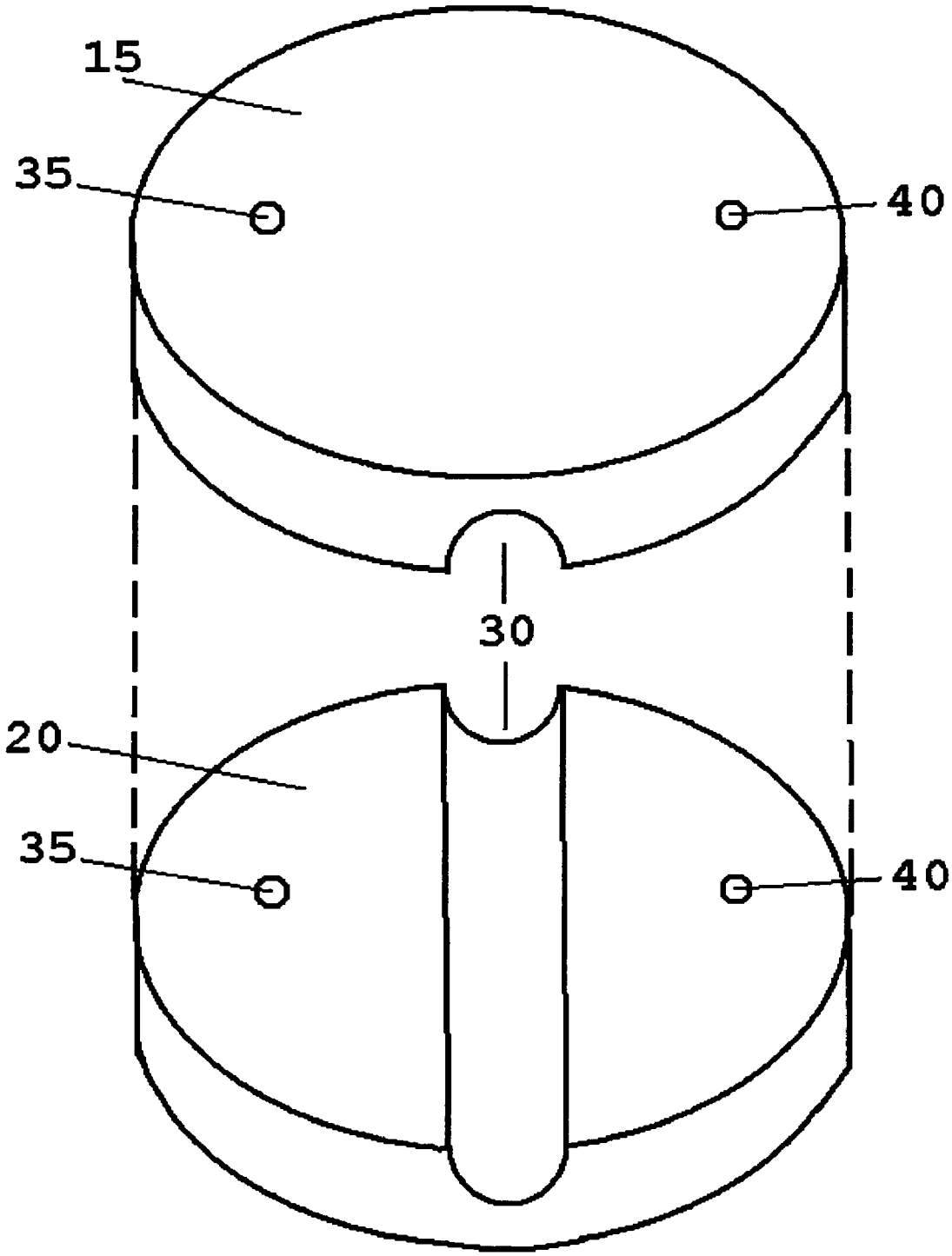
FIG. 4 depicts a perspective view of the formation of a two-piece embodiment of a magnetic induction device installed on a single power delivery line.
Figure 5:
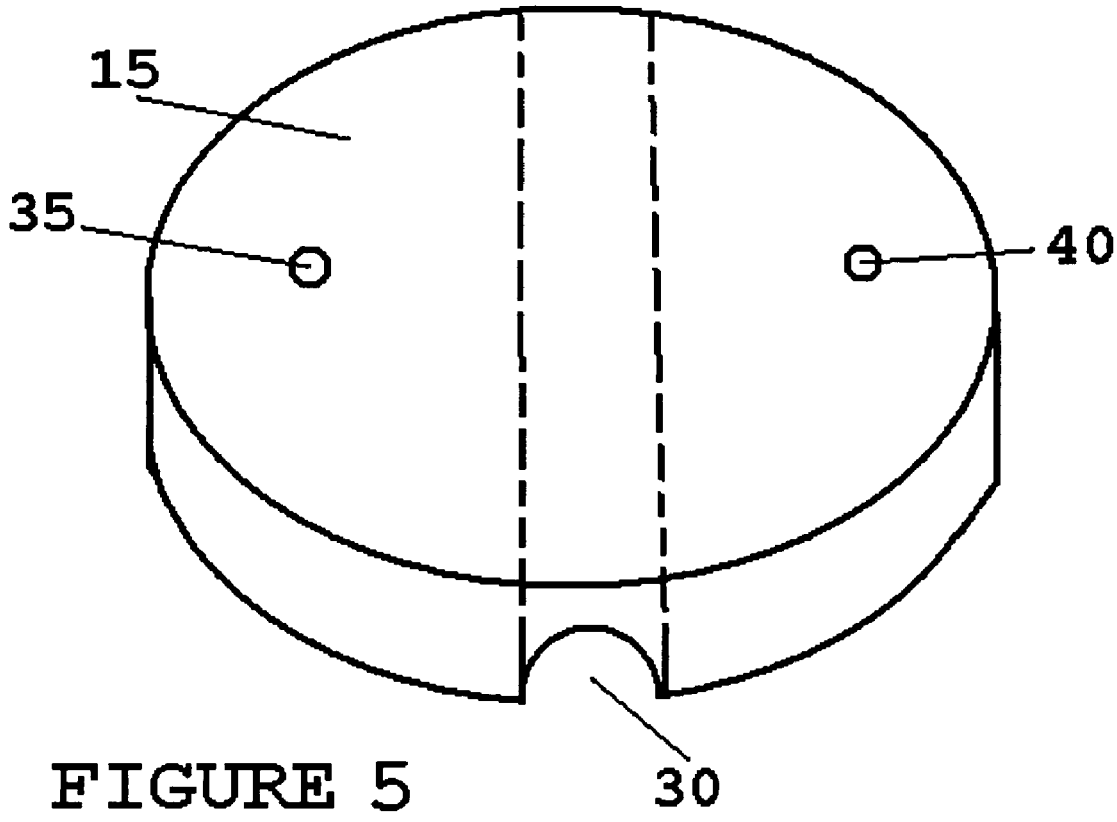
FIG. 5 depicts a perspective view of a cutaway perspective view of a one-piece embodiment of a magnetic induction device.

As depicted in FIG. 4, the first and second sections (15 and 20) are aligned so that the channel or gap (30) is aligned. The alignment of the channel or gap (30) creates a channel that extends the length of the magnetic induction device (10), as depicted in FIG. 5. The channel or gap (30) is larger than the wire diameter of the power delivery line (25) so that the magnetic induction device (10) does not add compression to the power delivery line (25).

The first and second sections (15 and 20) are held together by fasteners. The figures depict two fasteners (35 and 40), used to combine the first and second sections (15 and 20). Examples of usable fasteners include screws, threaded rivets, and non-compressing clips.

Although the present embodiments have been described with a certain degree of particularity, it is understood that the present disclosure is made by way of example only and that numerous changes in the detail of construction and the combination and arrangement of parts may be resorted to without departing from the spirit and scope of the invention as hereinafter claimed.

What is claimed is:

1. A method for making a magnetic induction device to control electricity, wherein the method comprises the steps of:

a. mixing a resin with a polymer forming a mixture;

b. adding a transition metal to the mixture forming a metalized mixture;

c. adding dimethyl sulfoxide to the metalized mixture;

d. mixture forming a liquid metalized mixture;

e. adding a magnetic powder to the liquid metalized mixture forming a magnetized mixture;

f. adding a catalyst to the magnetized mixture forming a hot mixture, wherein adding the catalyst causes an exothermic reaction heating the hot mixture to a temperature of up to about 250 degrees Fahrenheit;

g. pouring the hot mixture into a first mold and a second mold forming a first section and a second section;

h. cooling the first section and the second section to ambient temperature; and i. forming a gap in the first section and the second section and applying a fastener to the first section and the second section forming a magnetic induction device, wherein the gap in the first section and the second section fits around a power delivery line without compression.

2. The method of claim 1, further comprising the step of adding a pigment to the mixture.

3. The method of claim 1, wherein the pigment is selected from the group consisting of black, red, blue, grey, white, yellow, and combinations thereof.

4. The method of claim 1, further comprising the step of adding a filler to the mixture.

5. The method of claim 1, further comprising the step of adding a UV stabilizer to the mixture.

6. The method of claim 1, further comprising the step of adding an additive to the mixture to reduce brittleness of the magnetic induction device.

7. The method of claim 1, further comprising the step of adding an additive to the mixture to improve flexural modulus of the magnetic induction device.

8. The method of claim 1, further comprising the step of forming a chamber in the magnetic induction device after the step of cooling the first section and the second section.

9. The method of claim 8, wherein the step of cooling the first section and the second section to ambient temperature is performed for a time period of up to 3 hours.

10. The method of claim 1, wherein the step of forming the gap in the first section and the second section is performed by drilling.

11. A method for making an one-piece magnetic induction device to control electricity, wherein the method comprises the steps of a. mixing a resin with a polymer forming a mixture;

b. adding a transition metal to the mixture forming a metalized mixture;

c. adding dimethyl sulfoxide to the metalized mixture forming a liquid metalized mixture;

d. adding a magnetic powder to the liquid metalized mixture forming a magnetized mixture;

e. adding a catalyst to the magnetized mixture forming a hot mixture, wherein adding the catalyst causes an exothermic reaction heating the hot mixture to a temperature of up to about 250 degrees Fahrenheit;

f. pouring the hot mixture into a mold to form a magnetic induction device with a gap, wherein the gap fits around a power delivery line without compression; and g. cooling the magnetic induction device to ambient temperature.

12. The method of claim 11, further comprising the step of adding a pigment to the mixture.

13. The method of claim 11, wherein the pigment is selected from the group consisting of black, red, blue, grey, white, yellow, and combinations thereof.

14. The method of claim 11, further comprising the step of adding a filler to the mixture.

15. The method of claim 11, further comprising the step of adding a UV stabilizer to the mixture.

16. The method of claim 11, further comprising the step of adding an additive to the mixture to reduce brittleness of the magnetic induction device.

17. The method of claim 11, further comprising the step of adding an additive to the mixture to improve flexural modulus of the magnetic induction device.

18. The method of claim 11, further comprising the step of forming a chamber in the magnetic induction device after the step of cooling the magnetic induction device.

19. The method of claim 11, wherein the step of cooling the magnetic induction device to ambient temperature is performed for a time period of up to three hours.

20. The method of claim 11, further comprising the step of drilling the gap into the magnetic induction device.

* * * * *